US009242660B1

(12) United States Patent
Murphy

(10) Patent No.: US 9,242,660 B1
(45) Date of Patent: Jan. 26, 2016

(54) BRAKE BEAM STRUT PROTECTOR

(75) Inventor: Wayne H. Murphy, Pottstown, PA (US)

(73) Assignee: PENNSY CORPORATION, West Chester, PA (US)

( * ) Notice: Subject to any disclaimer, the term of this patent is extended or adjusted under 35 U.S.C. 154(b) by 198 days.

(21) Appl. No.: 12/592,945

(22) Filed: Dec. 4, 2009

(51) Int. Cl.
*B61H 13/36* (2006.01)
*B61H 13/34* (2006.01)

(52) U.S. Cl.
CPC ..... *B61H 13/36* (2013.01); *B61H 13/34* (2013.01)

(58) Field of Classification Search
CPC ..... B61H 13/00; B61H 13/34; B61H 13/36
USPC ..... 188/233.3, 229.1, 229.6, 231, 232, 233, 188/228.6
See application file for complete search history.

(56) References Cited

U.S. PATENT DOCUMENTS

| | | | | | |
|---|---|---|---|---|---|
| 800,409 | A | * | 9/1905 | Sharp | 188/232 |
| 949,882 | A | * | 2/1910 | Busse | 188/229.6 |
| 955,620 | A | * | 4/1910 | Walck | 188/228.6 |
| 1,106,765 | A | * | 8/1914 | Williams, Jr. | 188/226.1 |
| 1,519,765 | A | * | 12/1924 | Crone | 188/229.1 |
| 1,536,568 | A | * | 5/1925 | Crone | 188/229.1 |
| 1,943,271 | A | * | 1/1934 | Ivemeyer | 188/229.6 |
| 2,047,732 | A | * | 7/1936 | Harbert | 188/229.1 |
| 2,330,748 | A | * | 9/1943 | Sagstetter | 188/229.6 |
| 2,431,914 | A | * | 12/1947 | Brown | 188/229.1 |

* cited by examiner

*Primary Examiner* — Thomas J Williams
(74) *Attorney, Agent, or Firm* — John F. A. Earley, III; Frank J. Bonini, Jr.; Harding, Earley, Follmer & Frailey, P.C.

(57) ABSTRACT

A brake beam strut protector for protecting against wear of a brake beam strut slot surface of a slot of a brake beam strut of a brake beam assembly has a body, and a wear surface on the body for contacting a brake lever positioned in the slot of a brake beam strut and for spacing the brake lever away from the brake beam strut slot surface.

26 Claims, 10 Drawing Sheets

FIG. 5
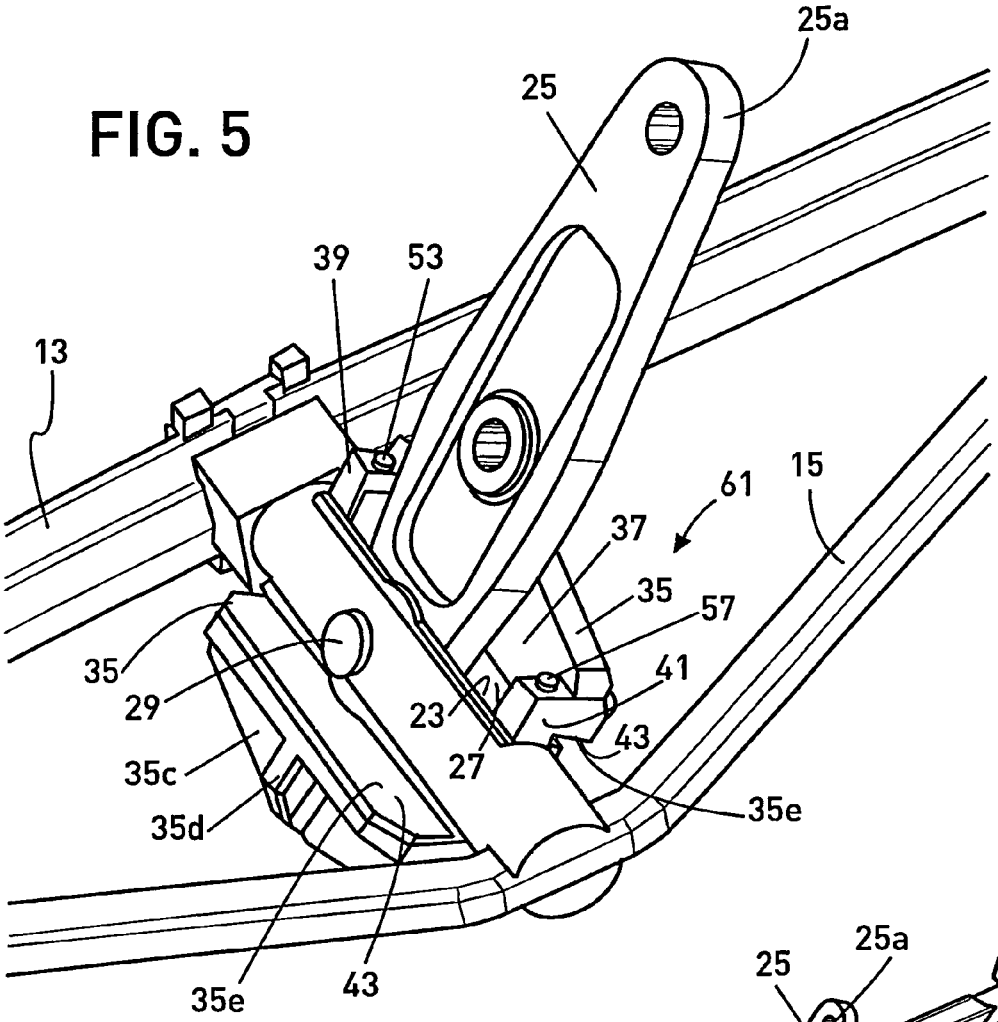
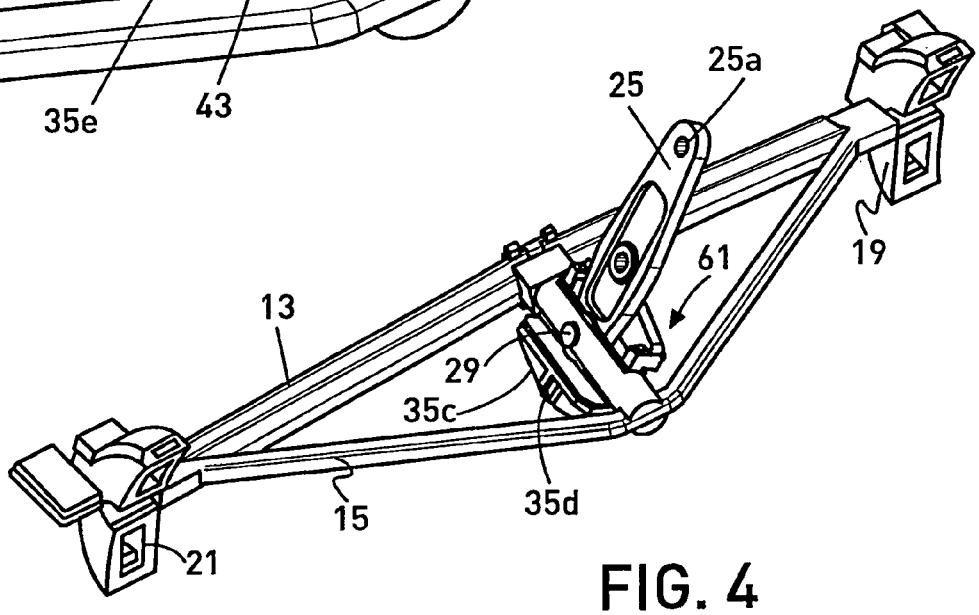
FIG. 4

BRAKE BEAM STRUT PROTECTOR

FIELD OF THE INVENTION

This invention relates to brake beams for use on railroad car trucks, and more particularly concerns brake beam strut protectors for protecting against wear of a brake beam strut slot surface of a brake beam strut and brake beam assemblies provided with such brake beam strut protectors. This invention also concerns extending the life span of a brake beam strut of a brake beam assembly for a railroad car truck, including extending the life span of a brake beam strut having less than ⅛ inch slot surface wear, as well as extending the life span of a brake beam strut having ⅛ inch or greater slot surface wear provided the structural integrity of such a strut is not compromised and the continued use of such a strut in conjunction with brake beam strut protectors of the invention meets with Association of American Railroads ("AAR") regulations or other regulatory requirements.

BACKGROUND OF THE INVENTION

Brake beam assemblies for railroad car trucks are frequently replaced due to wear of the brake beam strut slot surface caused by the brake lever moving back and forth and/or vibrating in the brake beam strut slot. An example of a brake beam strut having a brake beam strut slot surface 27 that has been worn by ⅛ inch or more is shown in FIG. 2. When the brake beam strut slot is worn by ⅛ inch or more, the Association of American Railroads ("AAR") Field Manual of Interchange Rule 6.A.6 requires replacement of the brake beam assembly.

The replacement of a worn brake beam assembly includes costs for materials and labor. Additional costs include having a railroad car out of service while replacement of the brake beam assembly takes place. Due to the high number of railroad cars and the high frequency of replacement of the brake beam assemblies, the overall costs to the railroad industry is substantial.

SUMMARY OF THE INVENTION

It is an object of the invention to reduce the occurrence of wear of the brake beam strut slot surface, and thereby reduce the frequency of a brake beam assembly being replaced due to wear of the brake beam strut slot surface.

Another object of the invention is to avoid the costs of replacing a brake beam assembly due to a worn brake beam strut slot surface, by preventing wear of the brake beam strut slot surface and/or by providing a smooth contact surface other than the brake beam strut slot surface for a brake lever to ride on.

It is another object of the invention to provide a brake beam strut protector for protecting against wear of a brake beam strut slot surface of a brake beam strut.

Still another object of the invention is to provide a brake beam assembly in which its brake beam strut slot surface of its brake beam strut is protected against wear.

These and other objects are provided by the invention as set forth below.

BRIEF DESCRIPTION OF THE DRAWINGS

FIG. 4 is a view in perspective of a brake beam strut protector 61 and a brake beam assembly having a brake beam strut protector 61 installed thereon, constructed in accordance with a preferred alternative embodiment of the invention.

FIG. 5 is an enlarged view of a portion of FIG. 4

DETAILED DESCRIPTION

Figure 1:
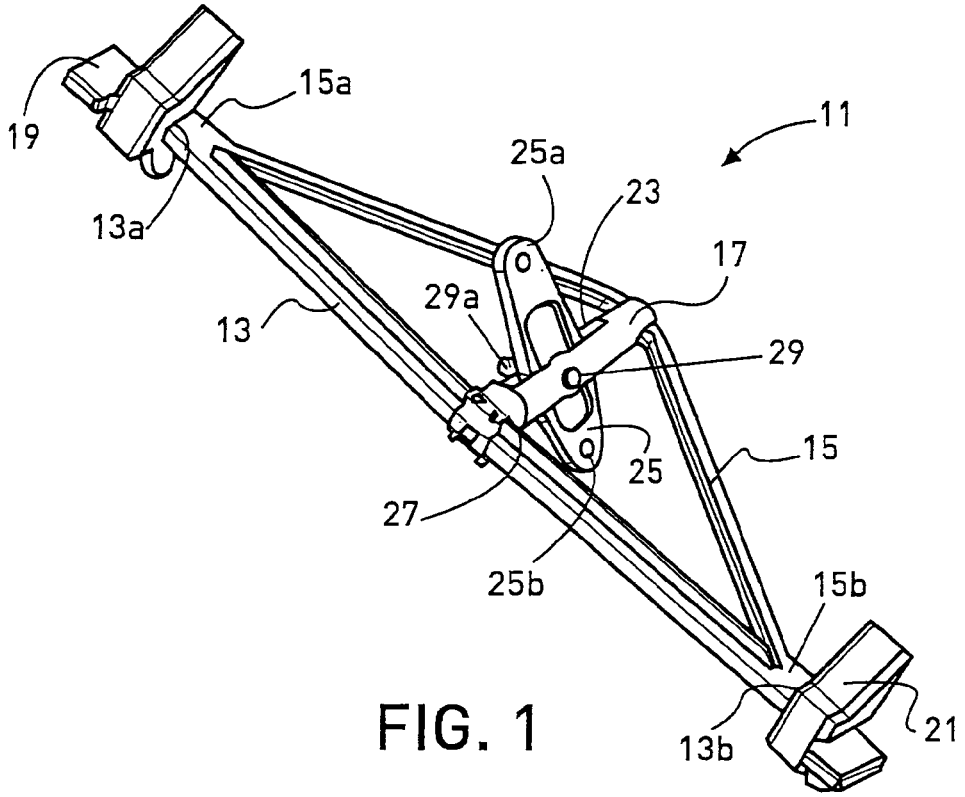
FIG. 1 is a view in perspective of an example of a brake beam assembly for a railroad car truck.
Figure 2:
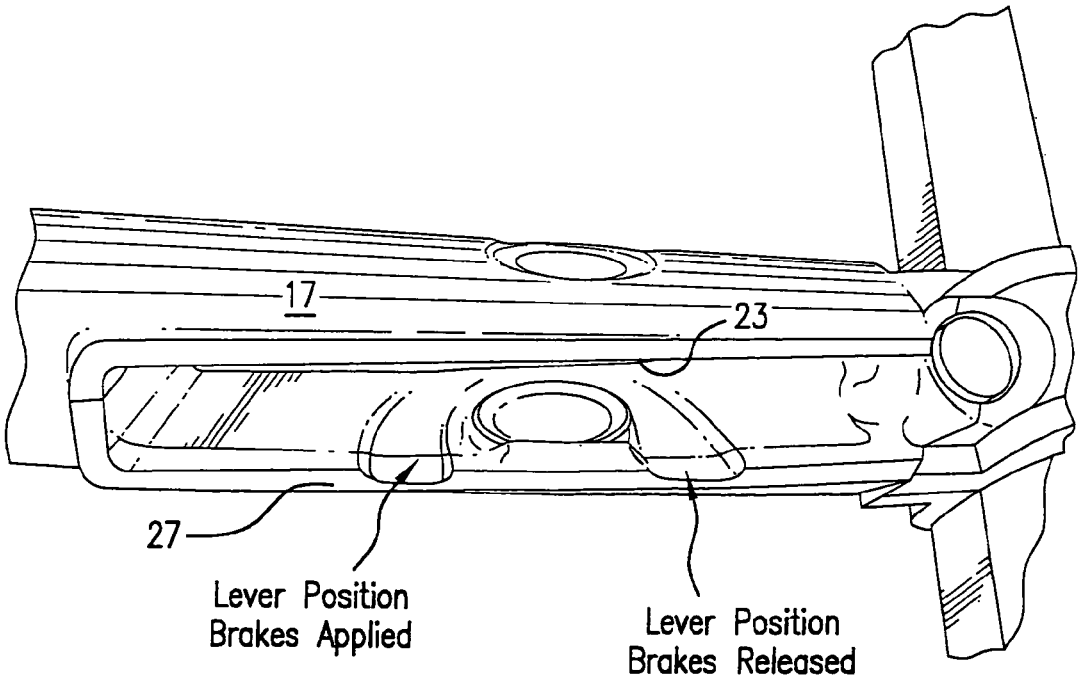
FIG. 2 is a view in perspective illustrating a brake beam strut that has a worn brake beam strut slot surface.

Turning now to the drawings, there is shown a brake beam assembly 11 for a railroad car truck. Brake beam assembly 11 has a compression member 13 having a first end portion 13*a* and a second end portion 13*b*, a tension member 15 having a first end portion 15*a* and a second end portion 15*b*, a brake beam strut 17, a first brake head 19, and a second brake head 21.

As is known in the art, the first brake head 19 is connected to the first end portion 13*a* of the compression member 13 and the first end portion 15*a* of the tension member 15, the second brake head 21 is connected to the second end portion 13*b* of the compression member 13 and the second end portion 15*b* of the tension member 15, and the brake beam strut 17 is connected to the compression member 13 and to the tension member 15.

The brake beam strut 17 has a slot 23 extending through it for receiving a brake lever 25. The slot 23 defines a brake beam slot surface 27 around the slot 23.

Figure 9:
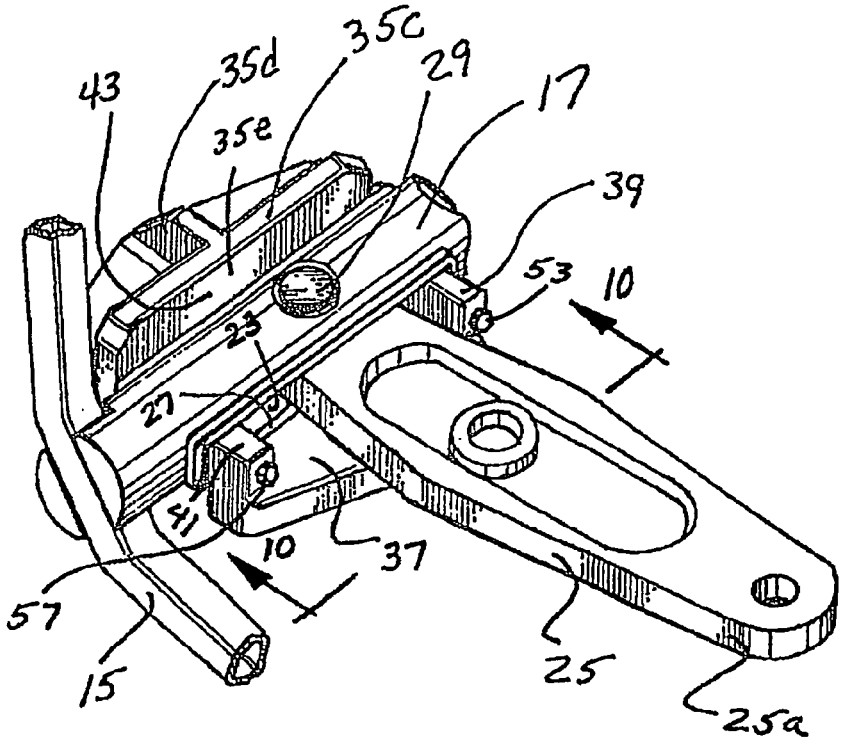
FIG. 9 is a partial view in perspective of the inventive brake beam strut protector 61 installed on a brake beam assembly.
Figure 10:
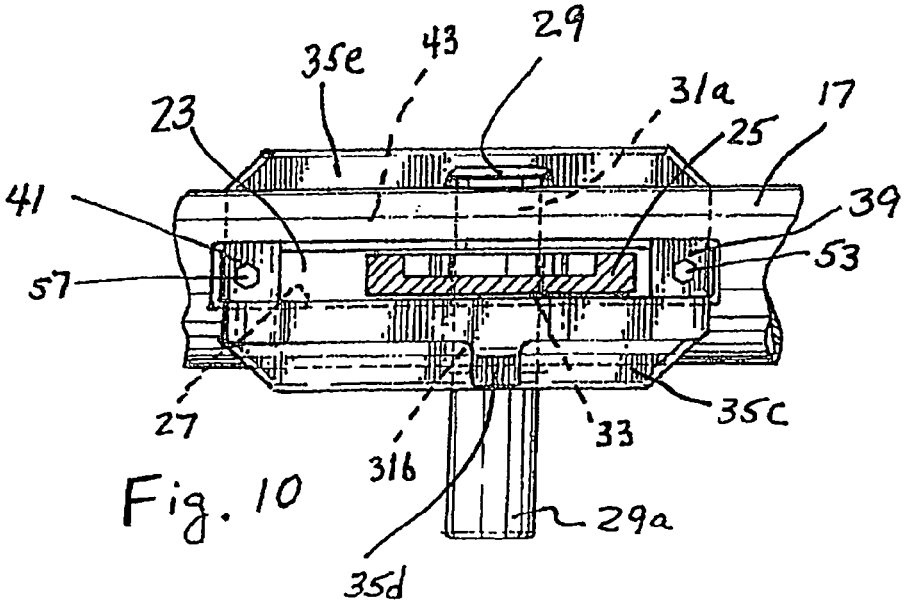
FIG. 10 is a view in cross-section taken along the lines and arrows 10-10 shown in FIG. 9.
Figure 11:
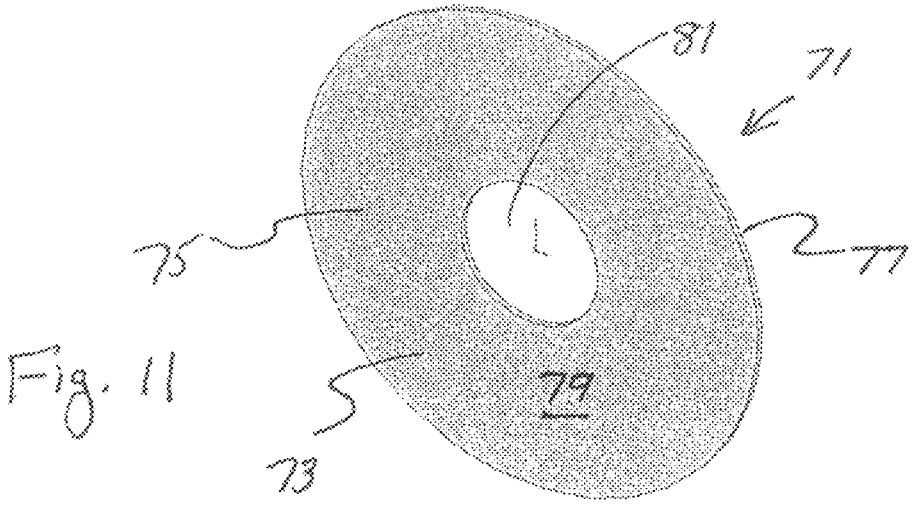
FIG. 11 is a view in perspective of another brake beam strut protector 71 constructed in accordance with another preferred embodiment of the invention.
Figure 12:
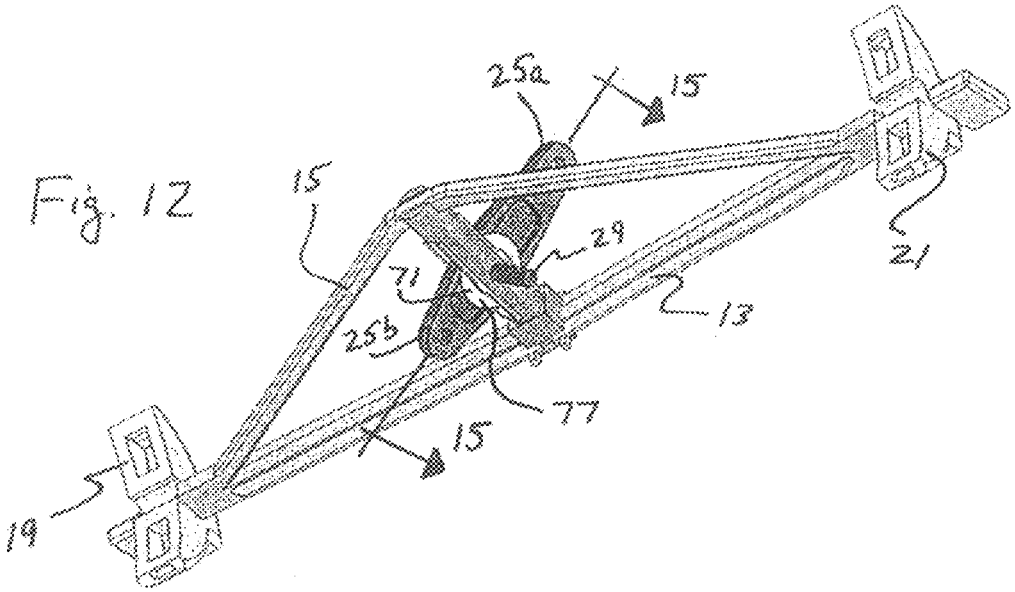
FIG. 12 is a view in perspective of another inventive brake beam assembly having the inventive brake beam strut protector 71 installed thereon.
Figure 13:
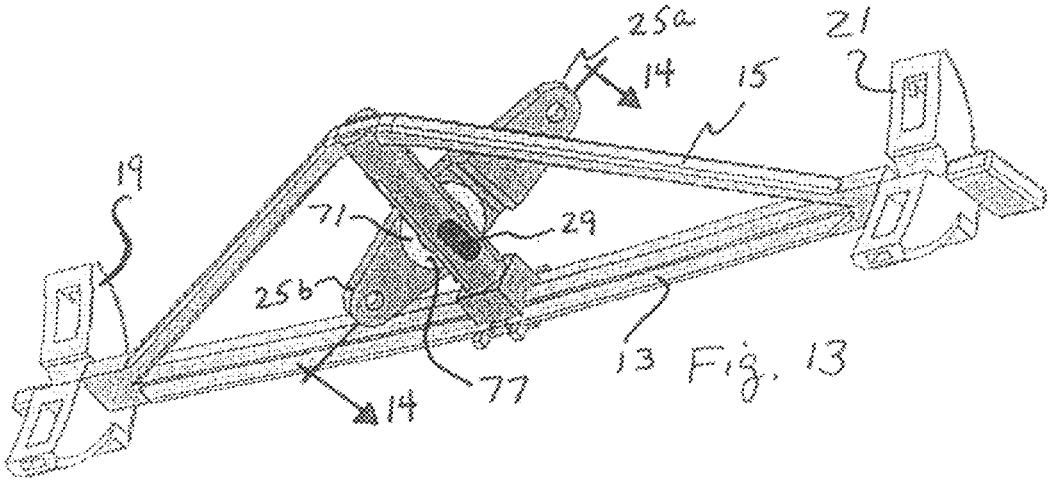
FIG. 13 is a view in perspective of another preferred inventive brake beam assembly having the inventive brake beam strut protector 71 installed thereon.
Figure 14:
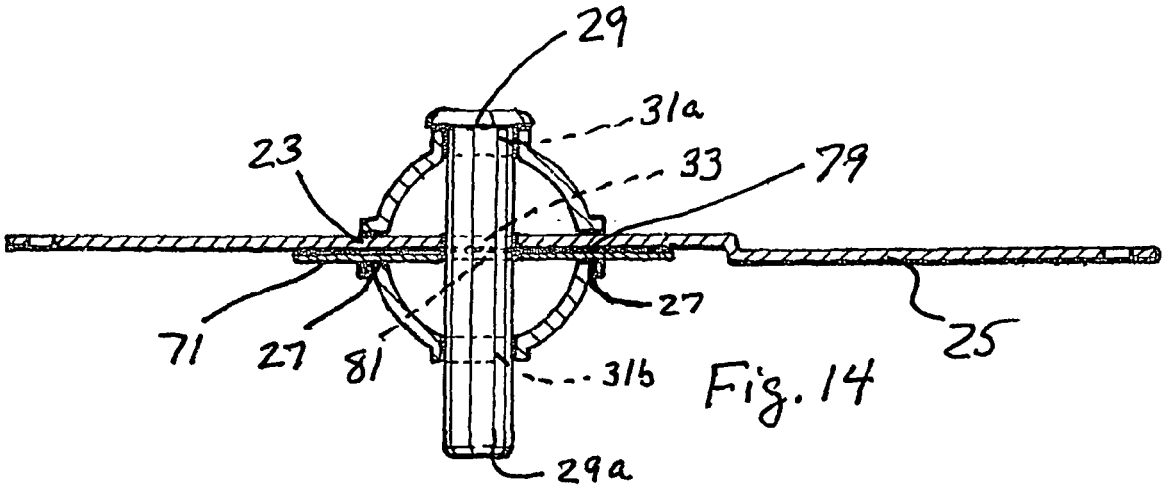
FIG. 14 is a view in cross-section taken along the lines and arrows 14-14 shown in FIG. 13.
Figure 15:
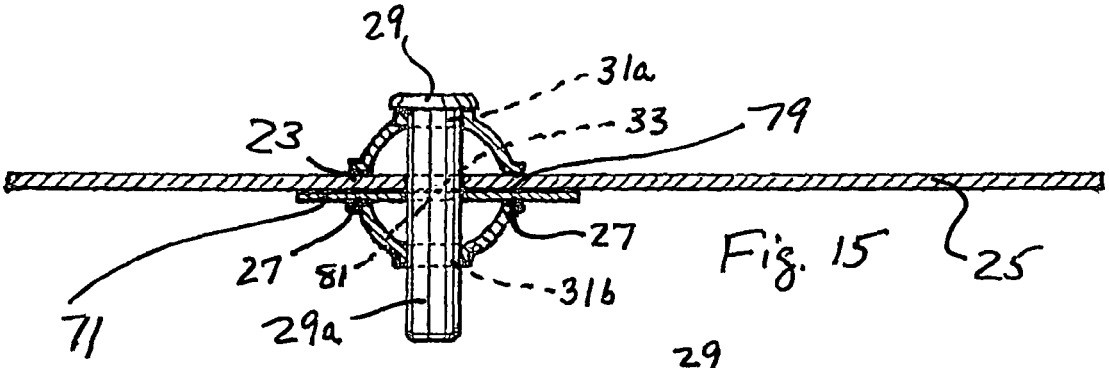
FIG. 15 is a view in cross-section taken along the lines and arrows 15-15 shown in FIG. 12.
Figure 19:
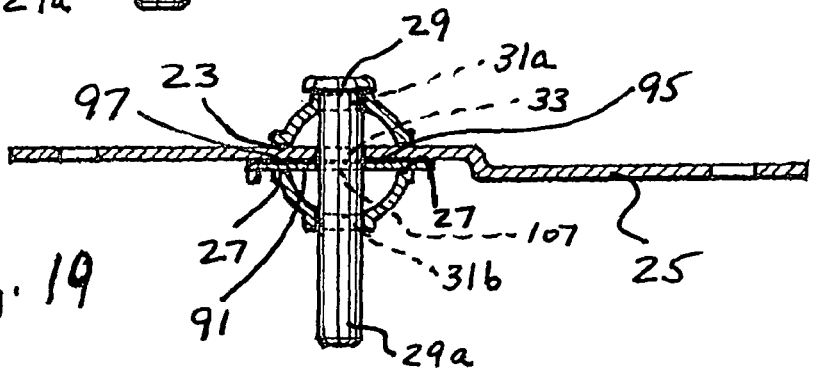
FIG. 19 is a view in cross-section taken along the lines and arrows 19-19 shown in FIG. 18.
Figure 20:
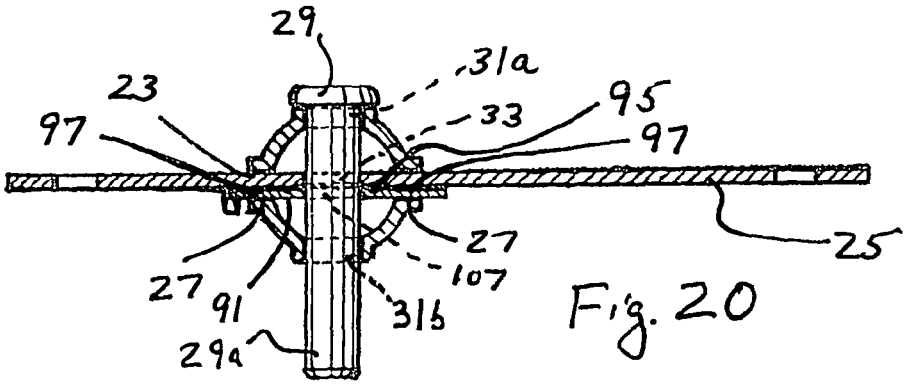
FIG. 20 is a view in cross-section taken along the lines and arrows 20-20 shown in FIG. 17.
Figure 16:
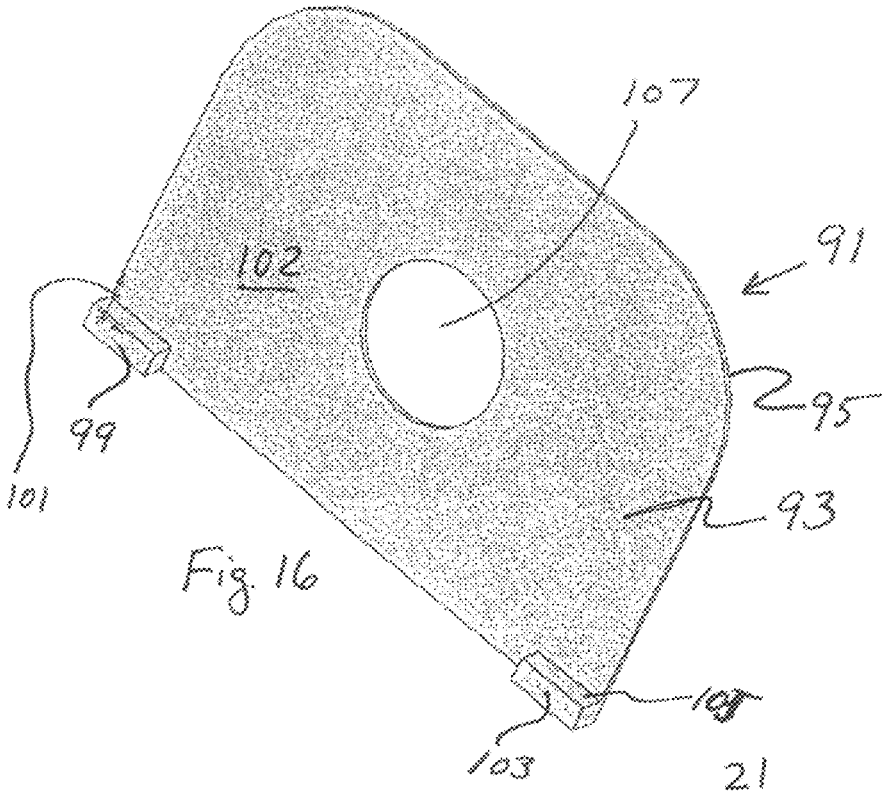
FIG. 16 is a view in perspective of another brake beam strut protector 91 constructed in accordance with another preferred embodiment of the invention.
Figure 17:
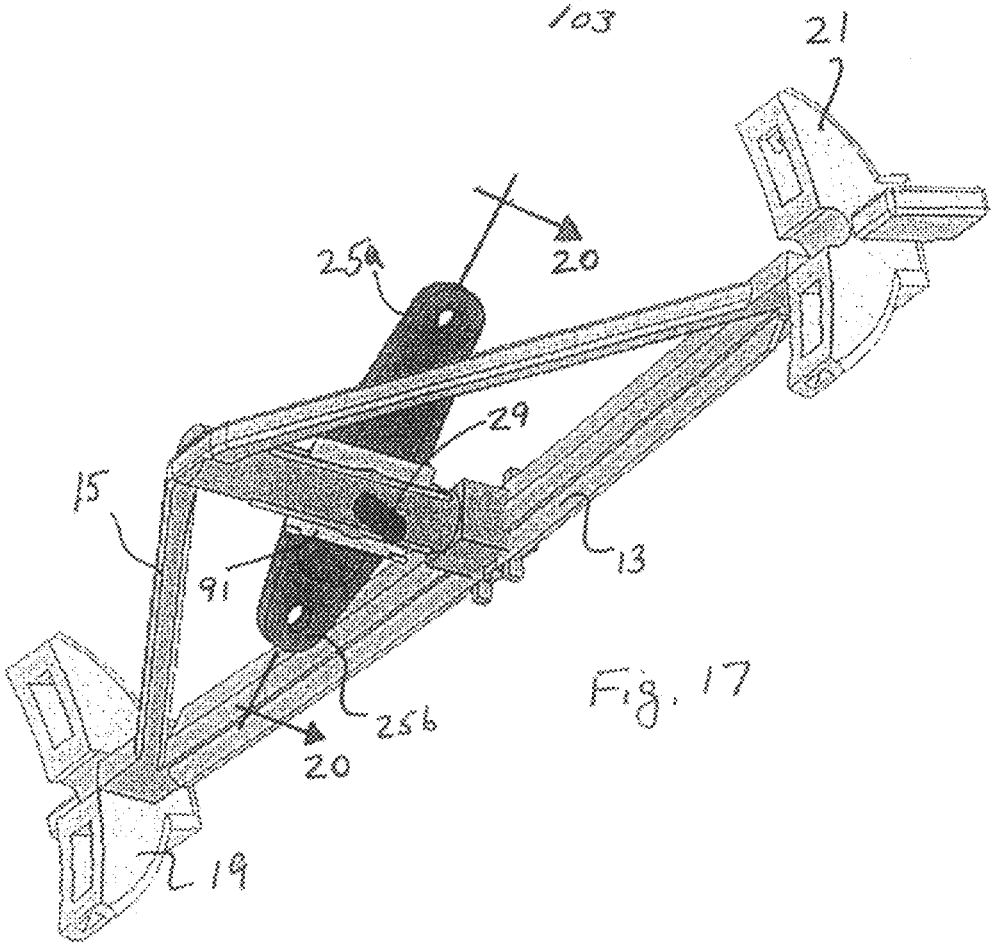
FIG. 17 is a view in perspective of another inventive brake beam assembly having the inventive brake beam strut protector 91 installed thereon.
Figure 18:
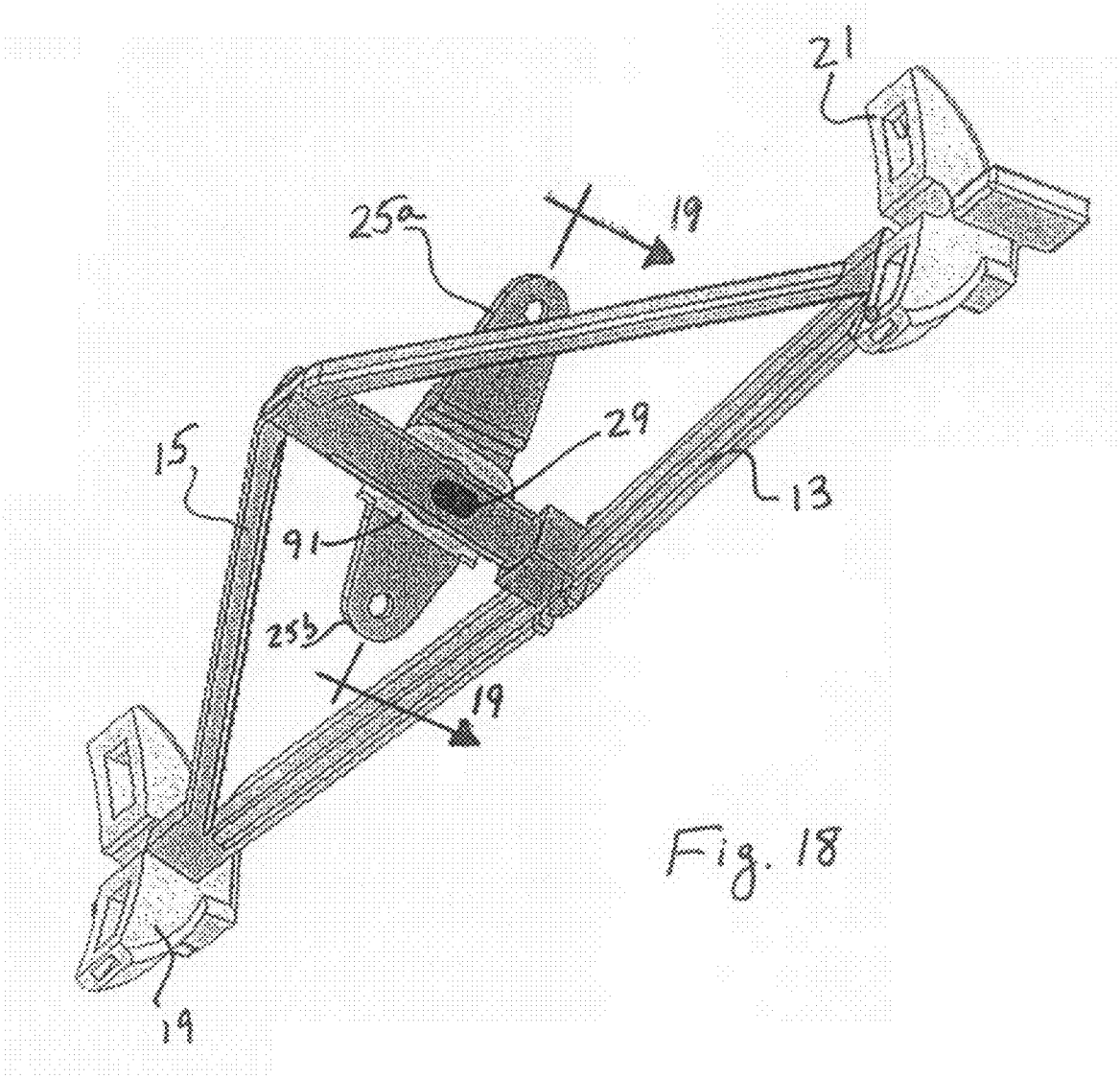
FIG. 18 is a view in perspective of another preferred inventive brake beam assembly having the inventive brake beam strut protector 91 installed thereon.

The brake lever 25 is secured in the slot 23 by a lever pin 29 that extends through the pin holes 31*a* and 31*b* formed in the brake beam strut 17 at the slot 23 and through a circular opening 33 formed in the brake lever 25 and is affixed to the brake beam strut 17. Depending on the configuration of the brake beam assembly 11, the brake lever 25 may have a first portion 25*a* extending from the slot 23 (as shown in FIGS. 4, 5, and 9) or a first portion 25*a* and a second portion 25*b* extending from the slot 23 (as shown in FIGS. 1, 12, 13, 17, and 18). Further, the brake lever 25 may be a straight brake lever (as shown in FIGS. 1, 4, 5, 9, 12, 15, 17, and 20) or a curved (e.g., having an offset portion) brake lever (as shown in FIGS. 13, 14, 18, and 19).

Additional details relating to the design and structure of brake beam assemblies may be found in the art, such as in U.S. Pat. Nos. 5,810,124, 6,155,388, and 6,155,389, all of which are incorporated herein by reference.

Figure 3:
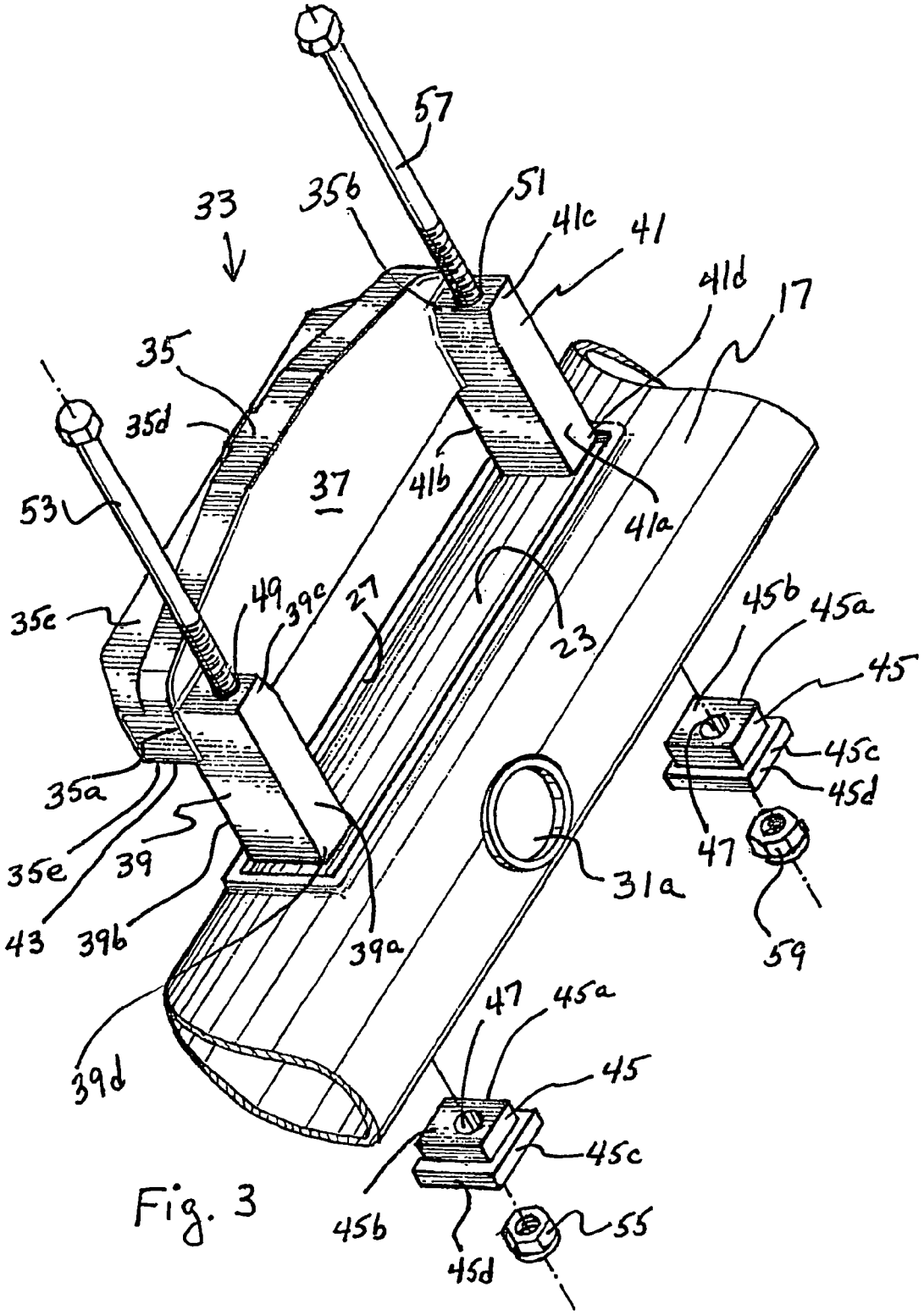
FIG. 3 is an exploded view of a preferred brake beam strut protector 33 constructed in accordance with the invention, to be installed on a brake beam strut.
Figure 6:
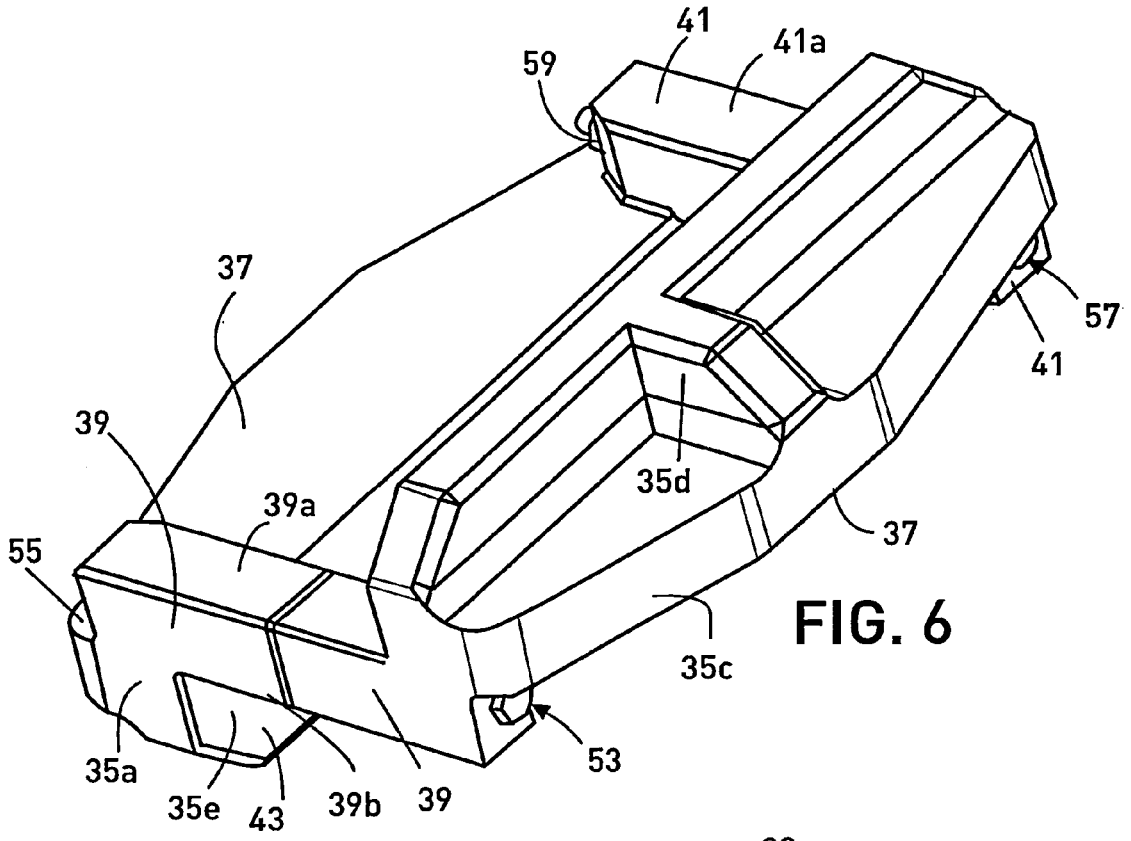
FIG. 6 is a view in perspective of the brake beam strut protector 61 shown in FIGS. 4 and 5.
Figure 7:
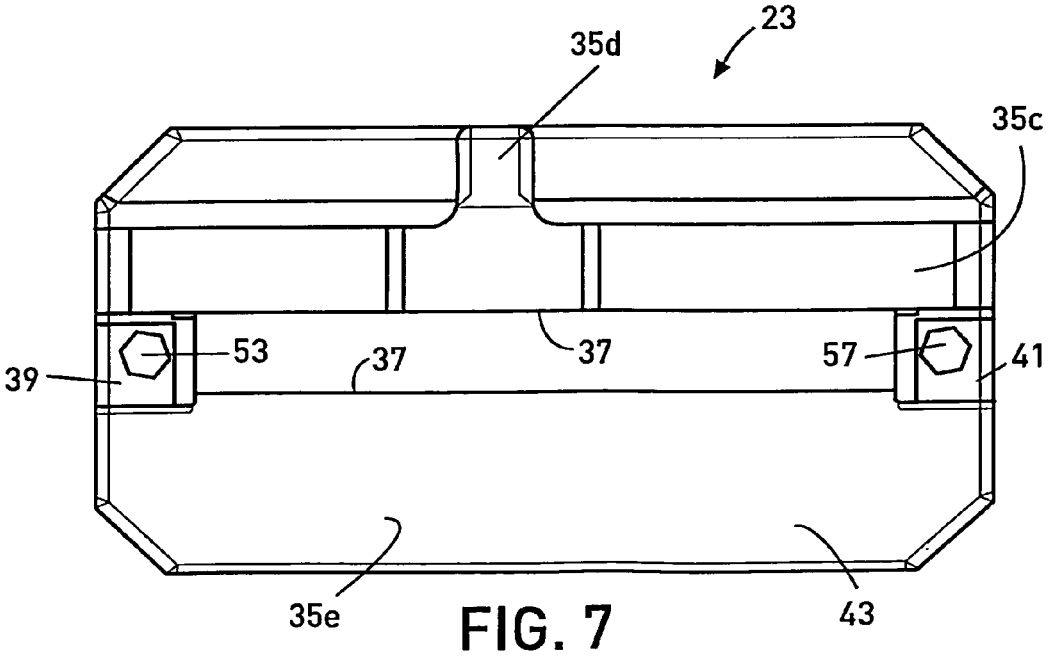
FIG. 7 is an end view in elevation of the brake beam strut protector 61 shown in FIG. 6.
Figure 8:
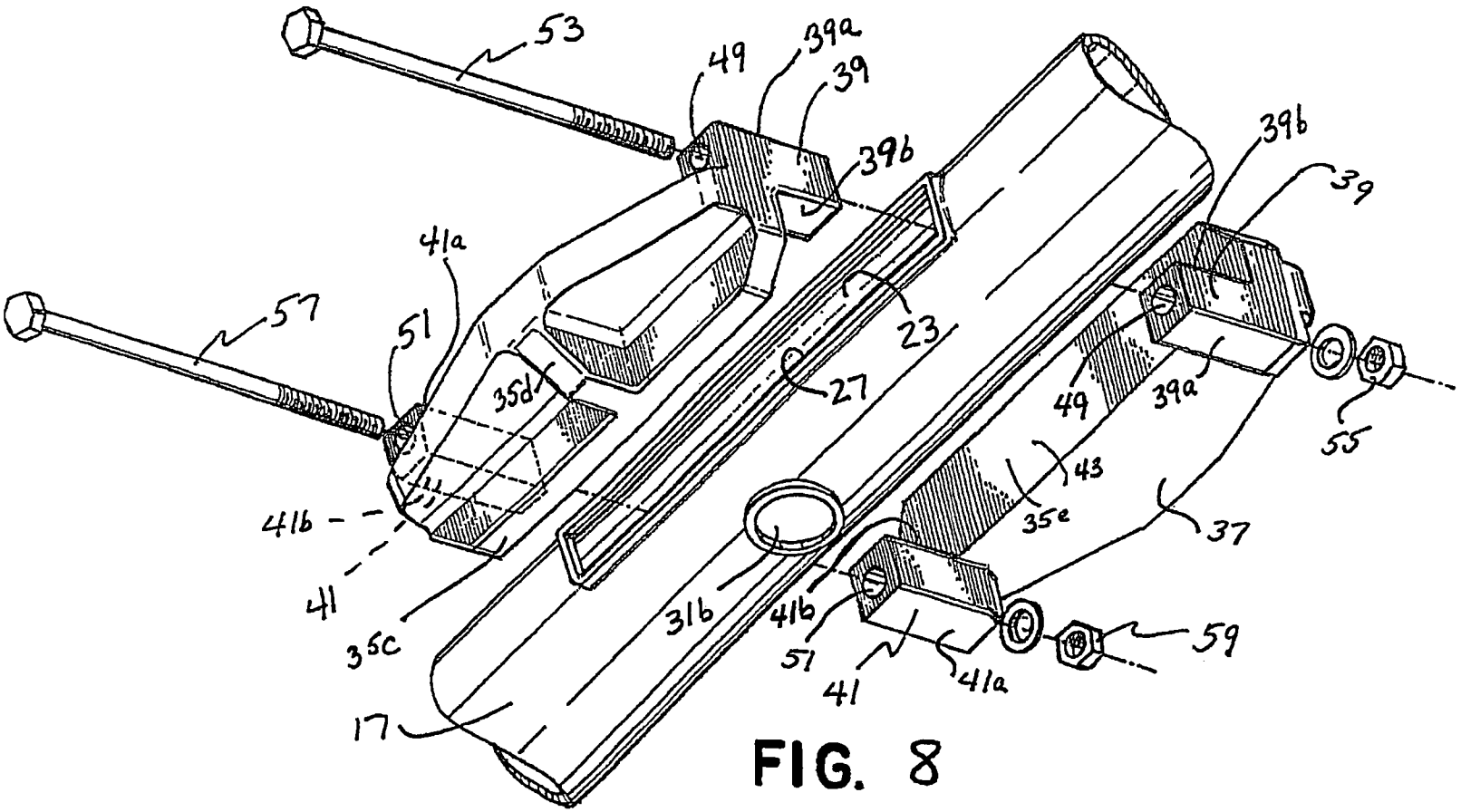
FIG. 8 is an exploded view of a brake beam strut protector 61, to be installed on a brake beam strut.

In a first embodiment of the invention shown in FIG. 3, a brake beam strut protector 33 is provided for protecting against wear of a brake beam strut slot surface 27 of a brake beam strut 17. In this embodiment of the invention, the brake beam strut protector 33 has a first body 35 having a wear surface 37 formed thereon for contacting a brake lever 25 positioned in the slot 23 of a brake beam strut 17 and for spacing the brake lever 25 away from the brake beam strut slot surface 27.

A first post 39 is positioned on a first end portion 35*a* of the first body 35, and a second post 41 is positioned on a second end portion 35*b* of the first body 35. The first post 39 has a front surface portion 39*a* that is positioned ahead of and parallel to the plane in which the wear surface 37 sits, and the first post 39 has a rear surface portion 39*b* that is positioned, at least below the bottom surface portion 35*e* of the body 35, behind and parallel to the plane in which the wear surface 37 sits. Accordingly, both the front surface portion 39*a* and the rear surface portion 39*b* (at least below the bottom surface portion 35*e* of the body 35) are offset (the front surface portion 39*a* being ahead of the plane of the wear surface 37, and the rear surface portion 39*b* (at least below the bottom surface portion 35*e* of the body 35) being behind the plane of the wear surface 37) from the plane of the wear surface 37.

Likewise, the second post 41 has a front surface portion 41*a* that is positioned ahead of and parallel to the plane in which the wear surface 37 sits, and the second post 41 has a rear surface portion 41*b* that is positioned, at least below the bottom surface portion 35*e* of the body 35, behind and parallel to the plane in which the wear surface 37 sits. Accordingly, both the front surface portion 41*a* and the rear surface portion 41*b* (at least below the bottom surface portion 35*e* of the body 35) are offset (the front surface portion 41*a* being ahead of the plane of the wear surface 37, and the rear surface portion 41*b* (at least below the bottom surface portion 35*e* of the body 35) being behind the plane of the wear surface 37) from the plane of the wear surface 37. Preferably, the cross-second of each post 39 and 41 is substantially square in shape, and the distances from the front surface portion 39*a* to the rear surface portion 39*b* and from the front surface portion 41*a* to the rear surface portion 41*b* are the same and sized to fit snuggly within the slot 23.

Preferably, the first body 35 is provided with rearwardly extending first flange 35*c* extending horizontally across the rear portion of the first body 35, and a rearwardly extending second flange 35*d* extending vertically across the rear portion of the first body 35 that intersects with the first flange 35*c*, for reinforcing the first body 35 behind the wear surface 37.

The bottom surface portion 35*e* of the first body 35 acts as a stop member 43 for preventing the brake beam strut protector 33 from being pulled completely through the slot 23 of the brake beam strut 17.

The first body 35 and the posts 39 and 41 may be made from metal (e.g., stainless steel) or polymer materials (e.g., nylon), and the first body 35 and the posts 39 and 41 may be integral with one another or component parts secured together using conventional methods known in the art.

To mount the brake beam strut protector 33 in place at the slot 23, the brake beam strut protector 33 is provided with two mounting members 45, each of which has a body 45*a* having an upper end portion 45*b*, a lower end portion 45*c*. The upper end portion 45*b* preferably has a substantially square cross-sectional shape and is sized to fit snuggly within the slot 23 of the brake beam strut 17. The lower end portion 45*c* of the body 45*a* of each mounting member 45 is provided with an outwardly extending flange portion 45*d*. A bore 47 extends completely through the body 45*a* of each mounting member 45 from its upper end portion 45*b* to its lower end portion 45*c*.

Also, a bore 49 extends completely through the first post 39 from its first end portion 39*c* to its second end portion 39*d*, and a bore 51 extends completely through the second post 41 from its first end portion 41*c* to its second end portion 41*d*.

A threaded bolt 53 and a nut 55 are used to fasten the first post 39 to one of the mounting members 45, and a threaded bolt 57 and a nut 59 are used to fasten the second post 41 to the other mounting member 45. The threaded bolt 53 has a shaft portion sized to be received and extend through in series the bore 49 in the first post 39 and the bore 47 in one of the mounting members 45, and the threaded bolt 57 also has a shaft portion sized to be received and extended through in series the bore 51 in the second post 41 and the bore 47 in the other mounting member 45.

In use, the posts 39 and 41 are inserted into the slot 23 of the brake beam strut 17 from one side of the slot 23 with the wear surface 37 of the brake beam strut protector 33 facing the brake lever 25. The upper end portion 45*b* of the body 45*a* of each mounting member 45 is inserted into the slot 23 from the other side of the slot 23, such that one of the mounting members 45 and the bore 47 extending therethrough are aligned with the first post 39 and the bore 49 extending therethrough, and the other mounting member 45 and the bore 47 extending therethrough are aligned with the second post 41 and the bore 51 extending therethrough. Then, the threaded bolt 53 is extended through the bore 49 in the first post 39 and through the bore 47 in the mounting member 45 aligned with the first post 39, the threaded bolt 57 is extended through the bore 51 in the second post 41 and through the bore 47 in the other mounting member 45 aligned with the second post 41, and nut 55 is screwed onto the end of the threaded bolt 53 and nut 59 is screwed on to the end of the threaded bolt 57 to preferably bring the stop member 43 into contact with the brake beam strut 17 outside the slot 23 and the flange portion 45*d* of each mounting members 45 into contact with the brake beam strut 17 outside the slot 23.

With the brake beam strut protector 33 in place, the brake lever 25 rides on the wear surface 37 rather than on the brake beam strut slot surface 27, since the wear surface 37 is in a plane that is higher than the plane of the brake beam strut slot surface 27 due to the plane of the wear surface 37 being offset from the plane of the rear surface portions 39*b* and 41*b* of the first and second posts 39 and 41. Accordingly, the brake beam strut protector 33 protects the brake beam strut slot surface 27 from wearing as the brake lever 25 is moved back and forth in the slot 23 of the brake beam strut 17.

In a second embodiment of the invention shown in FIGS. 4 to 10, a brake beam strut protector 61 is provided for protecting against wear of a brake beam strut slot surface 27 of a brake beam strut 17. In this embodiment of the invention, the brake beam strut protector 61 is substantially the same as the brake beam strut protector 33 (which comprises (1) a first segment that comprises a body 35 having a wear surface 37 formed thereon and a pair of posts 39 and 41 positioned on the body 35 as described above, (2) a pair of mounting members 45 as described above, and (3) a pair of bolts 53 and 57 and a pair of nuts 55 and 59 as described above), except that the mounting members 45 of the brake beam strut protector 33 are replaced by a substantial duplicate of the first segment of the brake beam strut protector 33 (that is, the mounting members 45 are replaced by a second segment that is substantially a duplicate of the first segment of the brake beam strut protector 33, the second segment comprising a body 35 having a wear surface 37 formed thereon and a pair of posts 39 and 41 positioned on the body 35 as described above), and except that preferably the posts 39 and 41 positioned on the body 35 of the first segment of this embodiment of the invention, as well as the posts 39 and 41 positioned on the body 35 of the second segment of this embodiment of the invention, are shorter in length than the posts 39 and 41 in the first embodiment of the invention, since preferably the posts 39 and the posts 41 of this second embodiment of the invention are all of equal length.

Preferably, in use, the posts 39 and 41 of the first segment of the protector 61 are inserted into the slot 23 of the brake beam strut 17 from one side of the slot 23 with the wear surface 37 of the body 35 of the first segment facing the brake lever 25, and the posts 39 and 41 of the second segment of the protector 61 are inserted into the slot 23 from the other side of the slot 23, such that the post 39 of first segment and the bore 49 that extends through the post 39 of the first segment are in alignment with the post 39 of the second segment and the bore 49 that extends through the post 39 of the second segment, and such that the post 41 of the first segment and the bore 51 that extends through the post 41 of the first segment are in alignment with the post 41 of the second segment and the bore 51 that extends through the post 41 of the second segment. With this arrangement, the wear surface 37 of one of the two segments faces the brake lever 25 from one side of the brake lever 25 and the wear surface 37 of the other of the two segments faces the brake lever 25 from the other side of the brake lever 25. That is, one of the wear surfaces 37 of the protector 61 faces one side of the brake lever 25, while the other wear surface 37 of the protector 61 faces the other side of the brake lever 25. An advantage of this embodiment of the invention is that it can be used for left or right hand brake beams.

In a third embodiment of the invention as shown in FIGS. 11 to 15, a brake beam strut protector 71 is provided for protecting against wear of a brake beam strut slot surface 27 of a brake beam strut 17. In this embodiment of the invention, the brake beam strut protector 71 has a body 73 that has a flat circular disk shape having a first side 75 and a second side 77. Preferably, either the first side 75 or the second side 77 constitutes a wear surface 79 for contacting a brake lever 25 positioned in the slot 23 of a brake beam strut 17 and for spacing the brake lever 25 away from the brake beam strut slot surface 27.

The body 73 of the brake beam strut protector 71 of this embodiment of the invention is provided with a central opening 81 through which a lever pin 29 around which the brake lever 25 rotates extends when the brake beam strut protector 71 is in use.

Preferably, when the brake beam strut protector 71 is used in #18 and #24 brake beams, its disk-shaped body 73 has a thickness of about 0.06 inches, and a diameter of about 5 inches. Preferably, the central opening 81 of such a body 73 has a diameter of about 1½ inches. Also, the body 73 of the third embodiment of the invention preferably is made from metal (e.g., stainless steel) using preferably a stamping manufacturing process (but also may be made using a cutting, molding, casting, or machining process), or a polymeric material (e.g., nylon) using an injection molding, casting, forming, or cutting process, or composites or non-metallic materials of various types using an injection molding, casting, forming, or cutting process.

With the brake beam strut protector 71 in place, the brake lever 25 rides on the wear surface 79 rather than on the brake beam strut slot surface 27. Accordingly, the brake beam strut protector 71 protects the brake beam strut slot surface 27 from wearing as the brake lever 25 is moved back and forth in the slot 23 of the brake beam strut 17.

In a fourth embodiment of the invention shown in FIGS. 16 to 20, a brake beam strut protector 91 is provided for protecting against wear of a brake beam strut slot surface 27 of a brake beam strut 17. In this embodiment of the invention, the brake beam strut protector 91 has a body 93 that has a flat front surface portion 95, and a part of surface portion 95 constitutes a wear surface 97 for contacting a brake lever 25 positioned in the slot 23 of a brake beam strut 17 and for spacing the brake lever 25 away from the brake beam strut slot surface 27. Preferably, the brake beam strut protector 91 of this embodiment of the invention has a substantially rectangular plate-like shape.

A blocking member is provided for preventing the brake beam strut protector 91 from rotating in the slot 23 completely around the lever pin when the brake beam strut protector 91 is in use. Preferably, the blocking member comprises a first stop 99 formed on the body 93 at the corner area 101 of the rear surface portion 102 of the body 93 and extending outwardly above the rear surface portion 102 sufficiently high enough to prevent the first stop 99 from entering the slot 23 when the protector 91 is in use, and a second stop 103 formed on the body 93 at the corner area 105 of the rear surface portion 102 of the body 93 and extending outwardly above the rear surface portion 102 sufficiently high enough to prevent the second stop 103 from entering the slot 23 when the protector 91 is in use.

The body 93 of the brake beam strut protector 91 of this embodiment of the invention is provided with a central opening 107 through which a lever pin 29 around which the brake lever 25 rotates extends when the brake beam strut protector 91 is in use.

Preferably, when the brake beam strut protector 91 is used in #18 and #24 brake beams, its body 93 has a thickness of about 0.06 inches, a height of about 4¼ inches, and a width of about 6 inches.

Also, the body 93 and the stops 99 and 103 preferably are integral with one another, and the protector 91 preferably is made from metal (e.g., stainless steel) using preferably a stamping manufacturing process, or a polymeric material (e.g., nylon) using an injection molding process.

With the brake beam strut protector 91 in place, the brake lever 25 rides on the wear surface 97 rather than on the brake beam strut slot surface 27. Accordingly, the brake beam strut protector 91 protects the brake beam strut slot surface 27 from wearing as the brake lever 25 is moved back and forth in the slot 23 of the brake beam strut 17.

Regarding the brake beam strut protectors 33 and 61 of the first and second embodiments of the invention, each brake beam strut protector 33 and 61 may be installed onto a brake beam strut 17 without having to disassemble the brake system, and such installation may be accomplished using only a wrench to tighten the nuts 55 and 59 onto the threaded bolts 53 and 57. Also, no welding is required.

Regarding the brake beam strut protector 71 of the third embodiment of the invention, if the brake beam assembly 11 is being assembled for the first time, the brake beam strut protector 71 may be installed by inserting the brake beam strut protector 71 into the slot 23 and positioning the protector 71 between the brake beam strut slot surface 27 and the brake lever 25 such that the central opening 81 in protector 71 is aligned with the opening 33 in the brake lever 25, and then inserting a lever pin 29 through the a first pin hole 31*a* in the brake beam strut 17, the opening 33 in the brake lever 25, the opening 81 to in the protector 71 then the other pinhole 31*b* in the brake beam strut 17, to the secure the brake lever 25 and the protector 71 in place in the slot 23. If protector 71 is to be installed on an assembled brake beam assembly 11, the end 29*a* of the lever pin 29 is at least first partially withdrawn from the second pin hole 31*b* and moved far enough into the slot 23 to create sufficient room for the protector 71 to be placed in the slot 23 between the brake lever 25 and the brake beam strut slot surface 27 without being blocked by the lever pin 29. Then, the protector 71 may be inserted into the slot 23 and positioned between the brake beam strut slot surface 27 and the brake lever 25 such that the opening 81 in the protector 71 is aligned with the opening 33 in the brake lever 25, and the lever pin 29 then may be positioned so that it extends through the pin hole 31*a*, the opening 33 in the brake lever 25, the opening 81 in the protector 71, and the pin hole 31*b*, to secure the brake lever 25 and the protector 71 in place in the slot 23.

Regarding the brake beam strut protector 91 of the fourth embodiment of the invention, if the brake beam assembly 11 is being assembled for the first time, the brake beam strut protector 91 may be installed by inserting the brake beam strut protector 91 into the slot 23 and positioning the protector 91 between the brake beam strut slot surface 27 and the brake lever 25 such that the central opening 107 in protector 91 is aligned with the opening 33 in the brake lever 25, and then inserting a lever pin 29 through the first pin hole 31*a* in the brake beam strut 17, the opening 33 in the brake lever 25, the opening 107 to in the protector 71 then the other pin hole 31*b* in the brake beam strut 17, to secure the brake lever 25 and the protector 91 in place in the slot 23. If protector 91 is to be installed on an assembled brake beam assembly 11, the end 29*a* of the lever pin 29 is at least first partially withdrawn from the second pin hole 31*b* and moved far enough into the slot 23 to create sufficient room for the protector 91 to be placed in the slot 23 between the brake lever 25 and the brake beam strut slot surface 27 without being blocked by the lever pin 29. Then, the protector 91 may be inserted into the slot 23 and positioned between the brake beam strut slot surface 27 and the brake lever 25 such that the opening 107 in the protector 91 is aligned with the opening 33 in the brake lever 25, and the lever pin 29 then may be positioned so that it extends through the pin hole 31*a*, the opening 33 in the brake lever 25, the opening 107 in the protector 91, and the pin hole 31*b*, to secure the brake lever 25 and the protector 91 in place in the slot 23.

By protecting against wear of a brake beam strut slot surface 27 of a brake beam strut 17, the brake beam strut protectors 33, 61, 71, and 91 extend the life span of the brake beam strut 17.

In addition to protecting against wear of a brake beam strut slot surface 27 of a brake beam strut 17, the brake beam strut protectors 33, 61, 71, and 91 may be used to extend the life span of a brake beam strut 17 that already has 1) a worn brake beam strut slot surface 27 of less than ⅛ inch of slot surface 27 wear, or 2) a worn brake beam strut slot surface 27 of ⅛ inch or more of slot surface 27 wear provided the structural integrity of such a strut 17 (e.g., a strut 17 having ⅛ inch or more of slot surface 27 wear) is not compromised and provided that the continued use of a brake beam strut 17 having ⅛ inch or more of slot surface 27 wear in conjunction with brake beam strut protectors 33, 61, 71, and 91 of the invention meets with Association of American Railroad ("AAR") regulations or other regulatory requirements. Rather than replacing a brake beam strut 17 having a worn brake beam strut slot surface 27 with a new brake beam strut 17, a brake beam strut protector 33, 61, 71, or 91 of the invention may be installed in place on the brake beam strut 17 that already has a worn brake beam strut slot surface 27 to block the brake lever 25 from contacting the worn brake beam strut slot surface 27 and to provide a smooth contact surface for the brake lever 25 to ride on as it is moved back and forth in the brake beam strut slot 23 between a "brakes applied" position and a "brakes released" position. By providing a smooth surface (the wear surface 37, 79, or 97) for the brake lever 25 to ride on, the problem of interference of movement of the brake lever 25 in the brake beam strut slot 23 caused by a worn brake beam strut slot surface 27 is avoided. Accordingly, a brake beam strut 17 having a worn slot surface 27, if provided with a brake beam strut protector 33, 61, 71, or 91 of the invention, may have continued life in service on a brake beam assembly 11, since the wear surface 37, 79, or 97 of the respective brake beam strut protector 33, 61, 71, or 91 provides a smooth contact surface for the brake lever 25 to ride on without interfering with the movement of the brake lever 25 in the brake beam strut slot 23 between a "brakes applied" position in the slot 23 and a "brake released" position in the slot 23, and since the wear surface 37, 79, or 97 of the respective brake beam strut protector 33, 61, 71, or 91 blocks the brake lever 25 from contacting the wore brake beam strut slot surface 27, thereby avoiding any possible interference by the worn brake beam strut slot surface 27 of such movement of the brake lever 25 in the slot 23.

The invention claimed is:

1. A brake beam strut protector for protecting against wear of a brake beam strut slot surface of a brake beam strut, comprising a first body, a wear surface on the first body for contacting a brake lever positioned in a slot of a brake beam strut and for spacing the brake lever away from the brake beam strut slot surface, and means for mounting the first body in place at the brake beam strut;

a first post positioned on a first end portion of the first body, a second post positioned on a second end portion of the first body, the first post and the second post each having a front surface portion that is positioned above and parallel to a plane in which the wear surface sits, the first post and the second post each having a lower post portion, the lower post portions having a rear surface portion that is positioned below and parallel to the plane of the wear surface of the first body, and the lower post portions being sized to fit snugly in the slot of the brake beam strut.

2. The brake beam strut protector of claim 1, said means for mounting the brake beam strut protector including a first mounting member having a body having an upper end portion, a lower end portion, a front portion, and a rear end portion, the upper end portion being sized to fit snugly within the slot of the brake beam strut, the lower end portion of the body of the first mounting member having a flange extending outwardly from the front portion of the body of the first mounting member, and the lower end portion of the body of the first mounting member having a flange extending outwardly from the rear portion of the body of the first mounting member, the first mounting member having a bore extending through the body of the first mounting member from the upper end portion of the body of the first mounting member to the lower end portion of the body of the first mounting member, a second mounting member having a body having an upper end portion, a lower end portion, a front portion, and a rear portion, the upper end portion being sized to fit snugly within the slot of the brake beam strut, the lower end portion of the body of the second mounting member having a flange extending outwardly from the front portion of the body of the second mounting member, and the lower end portion of the body of the second mounting member having a flange extending outwardly from the rear portion of the body of the second mounting member, the second mounting member having a bore extending through the body of the second mounting member from the upper end portion of the body of the second mounting member to the lower end portion of the body of the second mounting member, a bore extending completely through the first post from a top end portion of the first post to a bottom end portion of the first post, the bore extending through the first mounting member being aligned with the bore extending through the first post when the first mounting member is put in position below the first post, a first threaded bolt having a shaft portion sized to be received and extend through in series the bore in the first post and the bore in the first mounting member, a first nut for threading onto the shaft portion of the first bolt for securing the first post to the first mounting member after the shaft of the second bolt has been inserted through the bore in the first post and the bore in the first mounting member, a bore extending completely through the second post from a top end portion of the second post to a bottom end portion of the second post, the bore through the second mounting member being aligned with the bore extending through the second post when the second mounting member is put in position below the second post, a second threaded bolt having a shaft portion sized to be received and extend through in series the bore in the second post and the bore in the second mounting member, a second nut for threading onto the shaft portion of the second bolt for securing the second post to the second mounting member after the shaft of the second bolt has been inserted through the bore in the second post and the bore in the second mounting member, and a stop member formed on the brake beam strut protector for preventing the brake beam strut protector from being pulled completely through the slot of the brake beam strut.

3. The brake beam strut protector of claim 2, the stop member being formed on the first body.

4. A brake beam strut protector for protecting against wear of a brake beam slot surface of a brake beam strut, comprising a first portion and a second portion, the first portion comprising a first body, a wear surface on the first body for contacting a brake lever positioned in a slot of a brake beam strut and for spacing the brake lever away from the brake beam strut slot surface, and means for mounting the first body in place at the brake beam strut, the second portion comprising a second body, a wear surface on the second body for contacting the brake lever positioned in the slot of the brake beam strut and for spacing the brake lever away from the brake beam strut slot surface, and means for mounting the second body in place at the brake beam strut;

a first post positioned on a first end portion of the first body, a second post positioned on a second end portion of the first body, the first post and the second post each having a front surface portion that is positioned above and parallel to a plane in which the wear surface sits, the first post and the second post each having a lower post portion, the lower post portion of each of the first and the second posts having a rear surface portion that is positioned below and parallel to the plane of the wear surface of the first body, and the lower post portion of each of the first and second posts being sized to fit snugly in the slot of the brake beam strut, a third post positioned on a first end portion of the second body, a fourth post positioned on a second end portion of the second body, the third post and the fourth post each having a front surface portion that is positioned above and parallel to a plane in which the wear surface of the second body sits, the third post and the fourth post each having a lower post portion, the lower post portion of each of the third and fourth posts having a rear surface position that is positioned below and parallel to the plane of the wear surface of the second body, and the lower post portion of each of the third and the fourth posts being sized to fit snugly in the slot of the brake beam strut.

5. The brake beam strut protector of claim 4, the means for mounting the first body in place at the brake beam strut and the means for mounting the second body in place at the brake beam strut, comprising a first threaded bolt having a shaft portion sized to be received and extend through a bore extending completely through the first post from a top end portion to a bottom end portion of the first post and a bore extending completely through the fourth post from a top end portion to a bottom end portion of the fourth post when the first post and the bore therethrough are aligned with the fourth post and the bore therethrough, a first nut for threading onto the shaft portion of the first bolt after the first bolt has been extended through the bores in the first post and the fourth post for securing the first post to the fourth post, a second threaded bolt having a shaft portion sized to be received and extend through a bore extending completely through the second post from a top end portion to a bottom end portion of the second post and a bore extending completely through the third post from a top end portion to a bottom end portion of the third post when the second post and the bore therethrough are aligned with the third post and the bore therethrough, a second nut for threading onto the shaft portion of the second bolt after the second bolt has been extended through the bores in the second post and the third post for securing the second post to the third post, a first stop member formed on the first portion of the protector for preventing the first portion of the protector from being pulled completely through the slot of the brake beam strut, and a second stop member formed on the second portion of the protector for preventing the second portion of the protector from being pulled completely through the slot of the brake beam strut.

6. A brake beam assembly, comprising a compression member having a first end portion and a second end portion, a tension member having a first end portion and a second end portion, a brake beam strut connected to the tension member and the compression member, the brake beam strut having a slot extending therethrough for receiving a brake lever, the slot defining a brake beam strut slot surface around the slot, a first brake head, a second-brake head, the first brake head being connected to the first end portion of the compression member and the first end portion of the tension member, the second brake head being connected to the second end portion of the compression member and the second end portion of the tension member, the brake lever having a portion positioned in the slot and a portion extending from the slot, the brake lever secured in the slot by a lever pin, and a brake beam strut protector for protecting against wear of the brake beam strut slot surface of the brake beam strut, the protector comprising a first body a wear surface on the first body for contacting the brake lever positioned in the slot of the brake beam strut and for spacing the brake lever away from the brake beam strut slot surface, and means for mounting the first body in place at the brake beam strut;

a first post positioned on a first end portion of the first body, a second post positioned on a second end portion of the first body, the first post and the second post each having a front surface portion that is positioned above and parallel to a plane in which the wear surface sits, the first post and the second post each having a lower post portion, the lower post portions having a rear surface portion that is portioned below and parallel to the plane of the wear surface of the first body, and the lower post portions being sized to fit snugly in the slot of the brake beam strut.

7. The brake beam assembly of claim 6, said means for mounting the brake beam strut protector including a first mounting member having a body having an upper end portion, a lower end portion, a front portion, and a rear portion, the upper end portion being sized to fit snugly within the slot of the brake beam strut, the lower end portion of the body of the first mounting member having a flange extending outwardly from the front portion of the body of the first mounting member, and the lower end portion of the body of the first mounting member having a flange extending outwardly from the rear portion of the body of the first mounting member, the first mounting member having a bore extending through the body of the first mounting member from the upper end portion of the body of the first mounting member to the lower end portion of the body of the first mounting member, a second mounting member having a body having an upper end portion, a lower end portion, a front portion, and a rear portion, the upper end portion being sized to fit snugly within the slot of the brake beam strut, the lower end portion of the body of the second mounting member having a flange extending outwardly from the front portion of the body of the second mounting member, and the lower end portion of the body of the second mounting member having a flange extending outwardly from the rear portion of the body of the second mounting member, the second mounting member having a bore extending through the body of the second mounting member from the upper end portion of the body of the second mounting member to the lower end portion of the body of the second mounting member, a bore extending completely through the first post from a top end portion of the first post to a bottom end portion of the first post, the bore extending through the first mounting member being aligned with the bore extending through the first post when the first mounting member is put in position below the first post, a first threaded bolt having a shaft portion sized to be received and extend through in series the bore in the first post and the bore in the first mounting member, a first nut for threading onto the shaft portion of the first bolt for securing the first post to the first mounting member after the shaft of the second bolt has been inserted through the bore in the first post and the bore in the first mounting member, a bore extending completely through the second post from a top end portion of the second post to a bottom end portion of the second post, the bore through the second mounting member being aligned with the bore extending through the second post when the second mounting member is put in position below the second post, a second threaded bolt having a shaft portion sized to be received and extend through in series the bore in the second post and the bore in the second mounting member, a second nut for threading onto the shaft portion of the second bolt for securing the second post to the second mounting member after the shaft of the second bolt has been inserted through the bore in the second post and the bore in the second mounting member, and a stop member formed on the brake beam strut protector for preventing the brake beam strut protector from being pulled completely through the slot of the brake beam strut.

8. The brake beam assembly of claim 7, the stop member being formed on the first body.

9. A brake beam assembly, comprising a compression member having a first end portion and a second end portion, a tension member having a first end portion and a second end portion, a brake beam strut connected to the tension member and the compression member, the brake beam strut having a slot extending therethrough for receiving a brake lever, the slot defining a brake beam strut slot surface around the slot, the slot having a top and a bottom, at least one opening at the top of the slot, and at least one opening at the bottom of the slot, a first brake head, a second brake head, the first brake head being connected to the first end portion of the compression member and the first end portion of the tension member, the second brake head being connected to the second end portion of the compression member and the second end portion of the tension member, the brake lever having a portion positioned in the slot and a portion extending from the slot, the brake lever secured in the slot by a lever pin, and a brake beam strut protector for protecting against wear of the brake beam strut slot surface of the brake beam strut, the protector comprising a first portion and a second portion, the first portion comprising a first body, a wear surface on the first body for contacting the brake lever positioned in the slot of the brake beam strut and for spacing the brake lever away from the brake beam strut slot surface, and means for mounting the first body in place at the brake beam strut, the second portion comprising a second body, a wear surface on the second body for contacting the brake lever positioned in the slot of the brake beam strut and for spacing the brake lever away from the brake beam strut slot surface, and means for mounting the second body in place at brake beam strut; and a first stop member formed on the first portion of the protector for preventing the first portion of the protector from being pulled completely through the slot of the brake beam strut, and a second stop member formed on the second portion of the protector for preventing the second portion of the protector from being pulled completely through the slot of the brake beam strut;

wherein said wear surface of said first body is raised at the location of the slot top opening relative to said slot surface, and wherein said wear surface of said second body is raised at the location of the bottom slot opening relative to said slot surface.

10. The brake beam assembly of claim 9, wherein the first body is disposed parallel to said lever and along said brake beam slot surface.

11. A method of extending a life span of a brake beam strut of a brake beam assembly for a railroad car truck, the brake beam strut having a brake beam strut slot with a brake beam strut slot surface, a top opening and a bottom opening, comprising the steps of providing a brake beam strut protector, the brake beam strut protector having a body including a first portion and a second portion, a wear surface on the body for providing a smooth contact surface for a brake lever positioned in a slot of a brake beam strut to ride on and for spacing the brake lever away from the brake beam strut slot surface, means for mounting the body in place at the brake beam strut, a first stop member formed on the first portion of the protector for preventing the first portion of the protector from being pulled completely through the slot of the brake beam strut, and a second stop member formed on the second portion of the protector for preventing the second portion of the protector from being pulled completely through the slot of the brake beam strut, mounting the body of the brake beam strut protector in place at the brake beam strut so that when the body of the brake beam strut protector is in place the wear surface of the first portion of the protector is raised at the location of the slot top opening relative to said slot surface, and the wear surface of the second portion of the protector is raised at the location of the bottom slot opening relative to said slot surface;

maintaining with said first stop member the first portion of the protector in the assembly against being pulled completely through the slot of the brake beam strut, and maintaining with said second stop member the second portion of the protector in the assembly against being pulled completely through the slot of the brake beam strut, blocking the brake lever from contacting the brake beam strut slot surface with the wear surface of the body of the brake beam strut protector, and permitting movement of the brake lever over the wear surface and not over the brake beam strut slot surface of the brake beam strut.

12. A method of transforming a brake beam assembly having a brake beam strut that has a brake beam strut slot with a worn brake beam strut slot surface into a useable brake beam assembly, the brake beam strut slot having a top opening and a bottom opening, comprising the steps of providing a brake beam strut protector, the brake beam strut protector having a body including a first portion and a second portion, a wear surface on the body for providing a smooth contact surface for a brake lever positioned in a slot of a brake beam strut to ride on and for spacing the brake lever away from the worn brake beam strut slot surface, means for mounting the body in place at the brake beam strut, a first stop member formed on the first portion of the protector for preventing the first portion of the protector from being pulled completely through the slot of the brake beam strut, and a second stop member formed on the second portion of the protector for preventing the second portion of the protector from being pulled completely through the slot of the brake beam strut, mounting the body of the brake beam strut protector in place at the brake beam strut so that when the body of the brake beam strut protector is in place the wear surface of the first portion of the protector is raised at the location of the slot top opening relative to said slot surface, and the wear surface of the second portion of the protector is raised at the location of the bottom slot opening relative to said slot surface, maintaining with said first stop member the first portion of the protector in the assembly against being pulled completely through the slot of the brake beam strut, and maintaining with said second stop member the second portion of the protector in the assembly against being pulled completely through the slot of the brake beam strut, blocking the brake lever from contacting the worn brake beam strut slot surface with the wear surface of the body of the brake beam strut protector, and permitting movement of the brake lever over the wear surface and not over the worn brake beam strut slot surface of the brake beam strut.

13. A brake beam assembly, comprising a compression member having a first end portion and a second end portion, a tension member having a first end portion and a second end portion, a brake beam strut connected to the tension member and the compression member, the brake beam strut having a slot extending therethrough for receiving a brake lever, the slot defining a brake beam strut slot surface around the slot, a first brake head, a second brake head, the first brake head being connected to the first end portion of the compression member and the first end portion of the tension member, the second brake head being connected to the second end portion of the compression member and the second end portion of the tension member, the brake lever having a portion positioned in the slot and a portion extending from the slot, the brake lever secured in the slot by a lever pin, and a brake beam strut protector for protecting against wear of the brake beam strut slot surface of the brake beam strut, the protector comprising a first portion and a second portion, the first portion comprising a first body, a wear surface on the first body for contacting the brake lever positioned in the slot of the brake beam strut and for spacing the brake lever away from the brake beam strut slot surface, and means for mounting the first body in place at the brake beam strut, the second portion comprising a second body, a wear surface on the second body for contacting the brake lever positioned in the slot of the brake beam strut and for spacing the brake lever away from the brake beam strut slot surface, and means for mounting the second body in place at the brake beam strut, a first post positioned on a first end portion of the first body, a second post positioned on a second end portion of the first body, the first post and the second post each having a front surface portion that is positioned above and parallel to a plane in which the wear surface sits, the first post and the second post each having a lower post portion, the lower post portion of each of the first and the second posts having a rear surface portion that is positioned below and parallel to the plane of the wear surface of the first body, and the lower post portion of each of the first and second posts being sized to fit snugly in the slot of the brake beam strut, a third post positioned on a first end portion of the second body, a fourth post positioned on a second end portion of the second body, the third post and the fourth post each having a front surface portion that is positioned above and parallel to a plane in which the wear surface of the second body sits, the third post and the fourth post each having a lower post portion, the lower post portion of each of the third and fourth posts having a rear surface position that is positioned below and parallel to the plane of the wear surface of the second body, and the lower post portion of each of the third and the fourth posts being sized to fit snugly in the slot of the brake beam strut.

14. The brake beam assembly of claim 13, the means for mounting the first body in place at the brake beam strut and the means for mounting the second body in place at the brake beam strut, comprising a first threaded bolt having a shaft portion sized to be received and extend through a bore extending completely through the first post from a top end portion to a bottom end portion of the first post and a bore extending completely through the fourth post from a top end portion to a bottom end portion of the fourth post when the first post and the bore therethrough are aligned with the fourth post and the bore therethrough, a first nut for threading onto the shaft portion of the first bolt after the first bolt has been extended through the bores in the first post and the fourth post for securing the first post to the fourth post, a second threaded bolt having a shaft portion sized to be received and extend through a bore extending completely through the second post from a top end portion to a bottom end portion of the second post and a bore extending completely through the third post from a top end portion to a bottom end portion of the third post when the second post and the bore therethrough are aligned with the third post and the bore therethrough, a second nut for threading onto the shaft portion of the second bolt after the second bolt has been extended through the bores in the second post and the third post for securing the second post to the third post, a first stop member formed on the first portion of the protector for preventing the first portion of the protector from being pulled completely through the slot of the brake beam strut, and a second stop member formed on the second portion of the protector for preventing the second portion of the protector from being pulled completely through the slot of the brake beam strut.

15. A brake beam strut protector for protecting against wear of a brake beam strut slot surface of a brake beam strut, comprising a first body, a wear surface on the first body for contacting a brake lever positioned in a slot of a brake beam strut and for spacing the brake lever away from the brake beam strut slot surface, and means for mounting the first body in place at the brake beam strut;

the first body having a flat circular disk shape having a first side and a second side, the wear surface being located on either the first side or the second side, and the mounting means being a central opening formed in the first body through which a lever pin around which the brake lever rotates extends when the brake beam strut protector is in use;

said first body being in direct contact with the brake beam strut slot surface of the brake beam, wherein said brake beam strut slot surface is a planar surface and wherein said first body is disposed along said planar strut slot surface and makes direct contact with said brake beam strut slot surface.

16. The brake beam strut protector of claim 15, wherein said first body extends substantially to at least an opening of said brake beam strut slot.

17. The brake beam strut protector of claim 15, wherein said first body extends beyond an opening of said brake beam strut slot.

18. The brake beam strut protector of claim 15, wherein said first body is coextensive in length with the length of said brake beam strut slot.

19. A brake beam assembly, comprising a compression member having a first end portion and a second end portion, a tension member having a first end portion and a second end portion, a brake beam strut connected to the tension member and the compression member, the brake beam strut having a slot extending therethrough for receiving a brake lever, the slot defining a brake beam strut slot surface around the slot, a first brake head, a second brake head, the first brake head being connected to the first end portion of the compression member and the first end portion of the tension member, the second brake head being connected to the second end portion of the compression member and the second end portion of the tension member, the brake lever having a portion positioned in the slot and a portion extending from the slot, the brake lever secured in the slot by a lever pin and traversing a path within said brake beam strut slot, and a brake beam strut protector for protecting against wear of a brake beam strut slot surface of the brake beam strut, the protector comprising a first body a wear surface on the first body for contacting the brake lever positioned in the slot of the brake beam strut and for spacing the brake lever away from the brake beam strut slot surface, and means for mounting the first body in place at the brake beam strut;

the first body having a flat circular disk shape having a first side and a second side, the wear surface being located on either the first side or the second side, and the mounting means being a central opening formed in the first body through which a lever pin around which the brake lever rotates extends when the brake beam strut protector is in use;

said first body being in direct contact with the brake beam strut slot surface of the brake beam, wherein said brake beam strut slot surface is a planar surface and wherein said first body is disposed along said planar strut slot surface and makes direct contact with said brake beam strut slot surface.

20. The brake beam assembly of claim 19, wherein said first body extends substantially to at least the end of said brake beam strut slot.

21. The brake beam assembly of claim 19, wherein said first body extends beyond an opening of said brake beam strut slot.

22. The brake beam assembly of claim 19, wherein said first body is coextensive in length with the length of said brake beam strut slot surface.

23. A brake beam assembly, comprising a compression member having a first end portion and a second end portion, a tension member having a first end portion and a second end portion, a brake beam strut connected to the tension member and the compression member, the brake beam strut having a slot extending therethrough for receiving a brake lever, the slot defining a brake beam strut slot surface around the slot, the slot having a top and a bottom, at least one opening at the top of the slot, and at least one opening at the bottom of the slot, a first brake head, a second brake head, the first brake head being connected to the first end portion of the compression member and the first end portion of the tension member, the second brake head being connected to the second end portion of the compression member and the second end portion of the tension member, the brake lever having a portion positioned in the slot and a portion extending from the slot, the brake lever secured in the slot by a lever pin, and a brake beam strut protector for protecting against wear of a brake beam strut slot surface of the brake beam strut, the protector comprising a first body, a wear surface on the first body for contacting a brake lever positioned in a slot of a brake beam strut and for spacing the brake lever away from the brake beam strut slot surface, and means for mounting the first body in place at the brake beam strut; and a block member formed on the first body for preventing the protector from rotating completely around the lever pin when the brake beam strut protector is in use;

said wear surface covering said brake beam strut slot surface over the area of said path of travel of said lever;

wherein said first body is in direct contact with said brake beam strut slot surface of said brake beam; and wherein said wear surface of said first body is raised at the location of the slot top opening relative to said slot surface, and wherein said wear surface of said second body is raised at the location of the bottom slot opening relative to said slot surface.

24. A brake beam strut protector for protecting against wear of a brake beam strut slot surface of a brake beam strut, comprising a first body, a wear surface on the first body for contacting a brake lever positioned in a slot of a brake beam strut and for spacing the brake lever away from the brake beam strut slot surface, and means for mounting the first body in place at the brake beam strut;

the first body having a flat circular disk shape having a first side and a second side, the wear surface being located on either the first side or the second side, and the mounting means being a central opening formed in the first body through which a lever pin around which the brake lever rotates extends when the brake beam strut protector is in use;

said first body wear surface being coextensive along the length of the brake beam strut slot surface along the path traversed by said lever, and overlaps said brake beam strut slot surface;

wherein said first body is in direct contact with said brake beam strut slot surface of the brake beam.

25. A brake beam strut protector for protecting against wear of a brake beam strut slot surface of a brake beam strut, comprising a first body, a wear surface on the first body for contacting a brake lever positioned in a slot of a brake beam strut and for spacing the brake lever away from the brake beam strut slot surface, said slot surface underlying said brake lever, and means for mounting the first body in place at the brake beam strut;

the first body having a flat circular disk shape having a first side and a second side, the wear surface being located on either the first side or the second side, and the mounting means being a central opening formed in the first body through which a lever pin around which the brake lever rotates extends when the brake beam strut protector is in use, wherein said first body is arranged on said brake beam slot so that said wear surface is disposed to cover said brake beam slot surface underlying said brake lever; and wherein said first body is in direct contact with said brake beam strut slot surface of said brake beam and overlaps said brake beam strut slot surface.

26. A brake beam assembly, comprising a compression member having a first end portion and a second end portion, a tension member having a first end portion and a second end portion, a brake beam strut connected to the tension member and the compression member, the brake beam strut having a slot extending therethrough for receiving a brake lever, the slot defining a brake beam strut slot surface around the slot, a first brake head, a second brake head, the first brake head being connected to the first end portion of the compression member and the first end portion of the tension member, the second brake head being connected to the second end portion of the compression member and the second end portion of the tension member, the brake lever having a portion positioned in the slot and a portion extending from the slot, the brake lever secured in the slot by a lever pin and traversing a path within said brake beam strut slot, and a brake beam strut protector for protecting against wear of a brake beam strut slot surface of the brake beam strut, the protector comprising a first body, a wear surface on the first body for contacting the brake lever positioned in the slot of the brake beam strut and for spacing the brake lever away from the brake beam strut slot surface, and means for mounting the first body in place at the brake beam strut;

the first body having a flat circular disk shape having a first side and a second side, the wear surface being located on either the first side or the second side, and the mounting means being a central opening formed in the first body through which a lever pin around which the brake lever rotates extends when the brake beam strut protector is in use;

said first body being in direct contact with the brake beam strut slot surface of the brake beam; and wherein the first side or second side of the first body engages the brake beam strut slot surface.

* * * * *